United States Patent [19]

Dugasz

[11] 4,174,066

[45] Nov. 13, 1979

[54] CORROSION RESISTANT SELF-ALIGNING TRACK CONFIGURATIONS PARTICULARLY ADAPTED FOR RAILROAD CARS

[76] Inventor: William L. Dugasz, 396 Alpine St., Perth Amboy, N.J. 08861

[21] Appl. No.: 868,377

[22] Filed: Jan. 10, 1978

[51] Int. Cl.[2] ..... E01B 1/00; E01F 5/00

[52] U.S. Cl. ..... 238/7; 238/25; 238/205; 238/243; 238/264

[58] Field of Search ..... 238/1, 2, 3, 5, 6, 7, 238/9, 10 R, 24, 25, 187, 205, 208, 243, 264, 265

[56] References Cited

U.S. PATENT DOCUMENTS

| | | | |
|---|---|---|---|
| 934,054 | 9/1909 | Eisig | 238/25 |
| 1,013,736 | 1/1912 | Brown | 238/7 |
| 1,420,974 | 6/1922 | Day | 238/25 |
| 1,684,680 | 9/1928 | Oess | 238/9 |
| 1,720,187 | 7/1929 | Nagel | 238/9 |
| 1,820,911 | 9/1931 | Henderson | 238/7 |
| 2,719,676 | 10/1955 | Prater | 238/24 |
| 4,079,889 | 3/1978 | Halpenny | 238/7 |

FOREIGN PATENT DOCUMENTS

| | | | |
|---|---|---|---|
| 347442 | 4/1937 | Italy | 238/6 |

*Primary Examiner*—Randolph A. Reese
*Attorney, Agent, or Firm*—Arthur L. Plevy

[57] ABSTRACT

A replaceable track apparatus comprises two channels separated one from the other and formed in a concrete bed. The channels are lined with a corrosion resistant material and have located therein, a track containing vessel which comprises a corrosion resistant shell having a railroad track positioned therein at a predetermined location and supported by means of a reinforcing rod configuration secured to the track and held within the vessel by a concrete binder. The track vessel assemblies are located as indicated, in each channel. The apparatus assures the proper alignment of the track members to enable operation of a railway system on the tracks, while providing rapid removal and replacement of the track assemblies when desired, as the assemblies wear due to corrosion.

13 Claims, 6 Drawing Figures

CORROSION RESISTANT SELF-ALIGNING TRACK CONFIGURATIONS PARTICULARLY ADAPTED FOR RAILROAD CARS

BACKGROUND OF INVENTION

The present invention relates to tracks for example, of the type used on railway systems and to apparatus which facilitates the easy replacement and removal of tracks.

The prior art discloses a great number of patents which relate to the construction and fabrication of railroad track configurations. Essentially, patents such as U.S. Pat. No. 1,292,796 entitled A RAILROAD TIE AND CLAMP relate to such configurations wherein a railroad tie is formed principally of concrete. This patent shows track configurations which are secured in the concrete via recesses formed in the concrete which contains large coiled springs.

Patents such as U.S. Pat. No. 1,339,046 depict an entire rail and track assembly which is mainly fabricated from concrete and where a rail is held to a concrete base by the means of clamps secured to the track member via bolts. Other patents such as U.S. Pat. No. 2,337,497 depict a track configuration whereby tracks are secured to a concrete base member by means of large bolts operating in conjunction with a metal anchor box; which box is permanently embedded in the concrete. Other patents such as U.S. Pat. No. 3,382,815 and U.S. Pat. No. 3,907,200 depict alternate techniques of constructing and placing railroad track to primarily eliminate various problems which exist in the most conventional track formations as ones employing steel track and wooden railroad ties.

In any event and in spite of the many embodiments depicted in the prior art and contained in Class 104, Sub-class 236 and Class 238, Sub-classes 264, 265 and 267, there remains a greater problem which has not been solved by any of the prior art references as particularly described above. Namely, railroad cars are used in many operations besides transportation of persons or cargo. There are virtually thousands of miles of railroad track which are employed in various industrial processing procedures. As such, these tracks are used in the steel industry, the coal industry and so on to transport various waste matter from a processing plant to a disposal site.

In regard to the steel industry, railroad tracks are used to transport slag or other industrial wastes which may be formed during a coking operation. Railroad cars are used to transport coke to a quenching site. In such operations, the tracks employ wooden ties to anchor the steel rails as is conventional. Due to chemicals, alkalies and deleterious substances formed during such processes, these tracks are constantly subjected to deterioration and wear. Hence, in a typical industrial operation, the tracks are continuously being replaced due to the corrosive action of the quenching sustances. It is thus apparent that a great deal of money and time are spent each and every year in continuously replacing such track configurations.

It is therefore an object of the present invention to provide a track configuration which eliminates the need for wooden railroad ties, while providing apparatus which is easily and reliably replaceable.

BRIEF DESCRIPTION OF PREFERRED EMBODIMENT

A railroad track construction apparatus comprising a concrete bed of a predetermined length and having a top surface of a relatively triangular configuration forming a central apex relatively equidistant from a right and left side of said bed, said bed having first and second parallel U-shaped channels located on said top surface, with said first channel nearer said right side and spaced a given distance from said apex, and said second channel nearer said left side and spaced relatively the same distance from said apex, a first and second channel vessel, each of a "U" cross-sectional configuration relatively congruent with said first and second channel for insertion of said first and second vessels in said first and second channels, said vessels including a first track positioned at a predetermined location in said first vessel and a second track positioned at a predetermined location in said second vessel, each of said tracks extending from the open top of said "U" and positioned at said locations by means of a plurality of supporting rods retained between said track and said vessels by means of a concrete binder located within the hollow of said "U" shaped vessel.

DETAILED DESCRIPTION OF THE DRAWINGS

Figure 1:
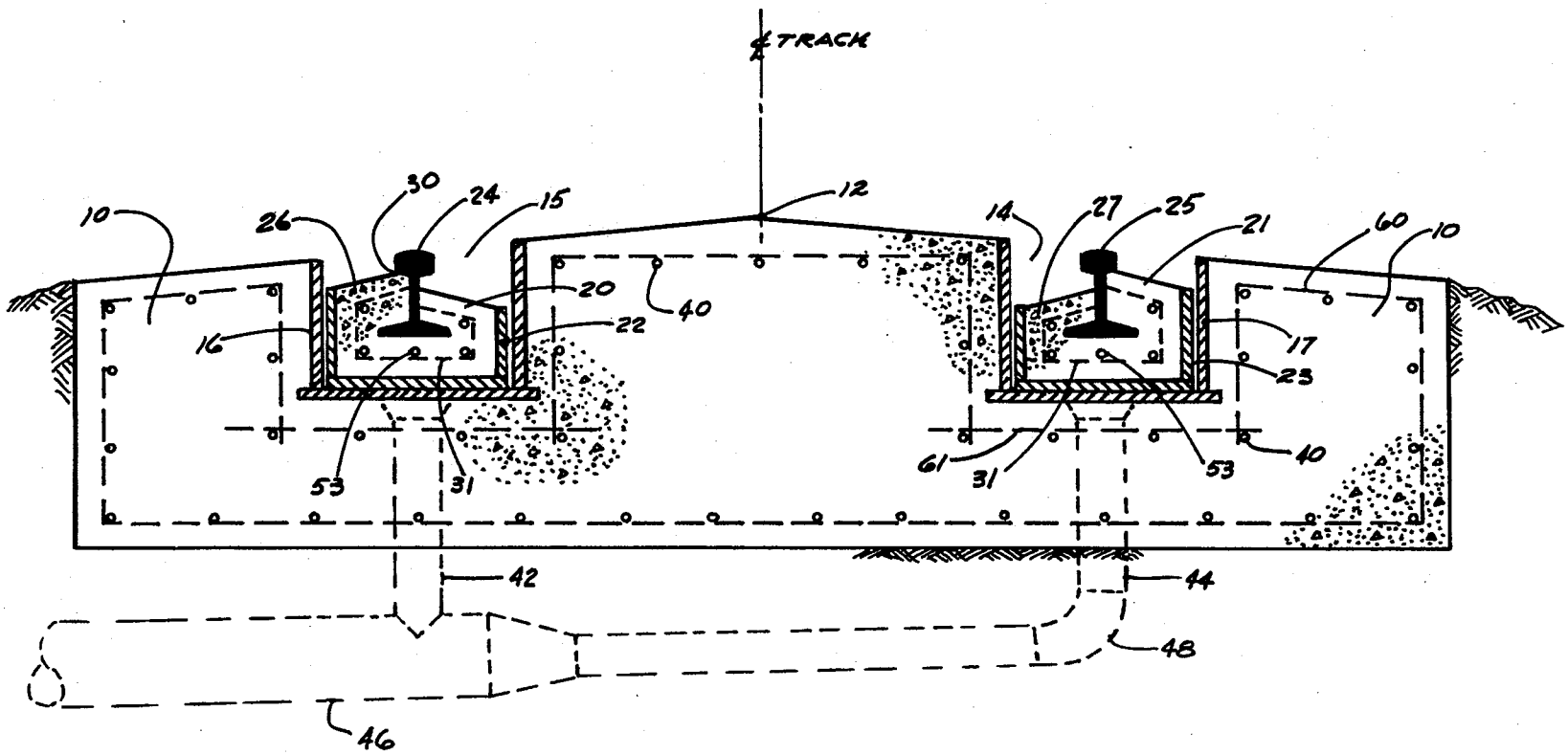
FIG. 1 is a cross-sectional view of a track configuration according to this invention.

Referring to FIG. 1, there is shown a cross-sectional view of a concrete base member 10. Essentially, the concrete base member is a bed of concrete which is formed in a trench dug or otherwise cut from a first to a second location. The bed 10 is formed in the ground by a suitable construction technique.

As can be seen from FIG. 1, the bed 10 possesses left and right sides of relatively the same height. A top surface of the bed extends from the left to right sides in a triangular configuration with a apex 12 terminating at a track center line. The fabrication of such concrete members as 10 is well within the skill of those engaged in the concrete pouring art. The concrete bed 10 may be poured directly into the channel formed in the ground or may be prefabricated at a remote location and thence, transported to a construction site.

Positioned from the apex 12 are two recesses 14 and 15 formed in the concrete structure. The recesses 14 and 15 comprise parallel U-shaped track channels and are located with their center lines a predetermined distance from the apex 12 of the track configuration. Each recess 14 and 15 has included therein a permanent corrosion resistant liner as 16 and 17. The liners may be fabricated from a highly corrosion resistant material such as stainless steel or other suitable metal alloys. Each channel liner as 16 and 17 is permanently embedded in the concrete and is a U-shaped cross-sectional configuration. As shown, the liners 16 and 17 have flanged bottom surfaces which cause the same to be permanently secured within the concrete bed 10.

Disposed in each liner is a replaceable track accommodating vessel 20 and 21. The vessels 20 and 21 comprise elongated steel containers as 22 and 23. The containers 22 and 23 are also fabricated from a corrosion resistant material and are rectangular in cross-section with an open top. In essence, the vessels 22 and 23 are elongated channel members.

Accurately secured within each vessel is a steel railroad track as 24 and 25. The tracks 24 and 25 may be, for example, one hundred thirty-two pound A.R.E.A. configurations and are accurately aligned and positioned within their associated vessels as 22 and 23.

The tracks are secured at a predetermined level and central position by permanently securing the same within the vessel 22 by means of a liner or binder 26 of concrete. The concrete 26 is disposed in each vessel so that the outer edge of the track is restrained by the concrete liner at a greater level than the inner edge.

As shown in the FIG, one side of the member 22 and 23 is higher than the other side. For example, in regard to member 22, the left side of the vessel is slightly higher than the right side. The concrete liner is directed from the left side of the member to the bottom of the flange 30 formed by the track configuration. The right side is slightly lower and the concrete liner emanates at a taper from the right side to a point on the central flange of the track 24.

The track is accurately positioned within the container by means of preplaced supporting rod configurations 31. The rods 31 shown in dashed lines in the FIG are aligned at predetermined intervals along the track prior to pouring the concrete liner 26. These reinforcing rods assure the accurate and permanent alignment of the track members 24 and 25 with respect to the channel vessels 22 and 23 to accurately determine the position of each track with respect to the apex 12 of the concrete bed.

Also shown in the FIG are a plurality of supporting rods or reinforcing bars as 40 which are inserted about the periphery of a concrete bed to further strengthen and reinforce the structure. As will be explained, such rods as 40 are fabricated from steel and are inserted both parallel and transverse to the channels as 14 and 15 disposed in the concrete bed.

The concrete bed has also preformed therein along given intervals, a series of apertures which coact with drain pipes as 42 and 44. The steel liners 16 and 17 also possess suitable apertures at predetermined intervals wich align with the drain pipes 42 and 44. The drain pipes associated with each track are coupled to a common drainage pipe 46 through suitable coupling assemblies as 48. It is understood that the drainage pipes as 42 and 44 are disposed at predetermined intervals along the length of the track. The pipes may be fabricated from a suitable non-corrosive material such as a suitable plastic or metals and serves to drain or remove any liquids which may fall into the recesses during operation of the railroad system.

Figure 2:
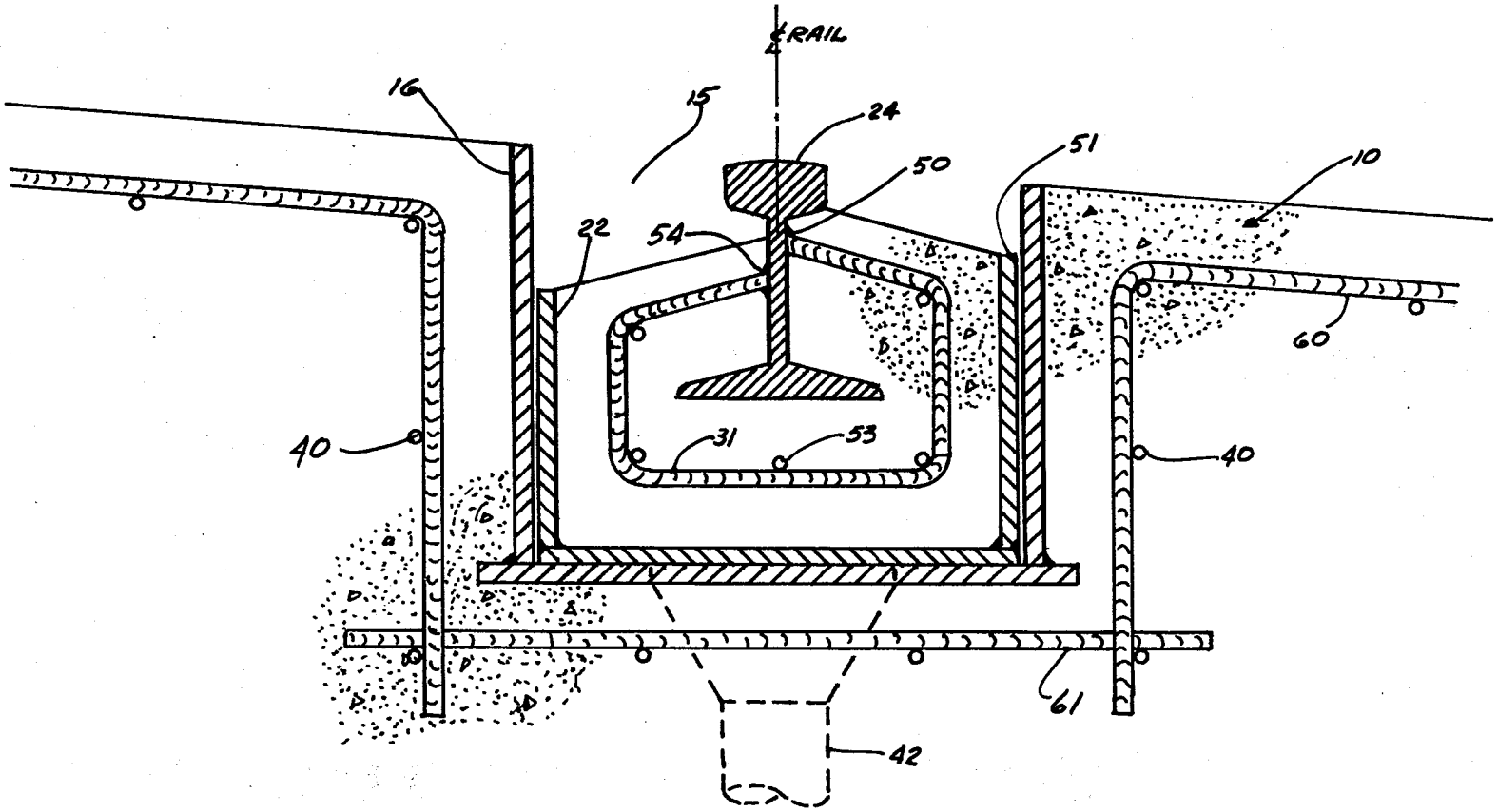
FIG. 2 is a partial cross-sectional view showing a track retaining assembly in a channel according to this invention.

Referring to FIG. 2, there is shown a cross-sectional view of a typical track member as 24 of FIG. 1. Essentially, the track 24 is retained in position with respect to a steel channel vessel 22 by means of a plurality of reinforcing rods 31. Each rod as 31 is welded to the track 24 at a first location 50. As seen in FIG. 2, the reinforcing rod 31 is welded to the outer edge of the track at a top position 50. It is noted that this edge of the track is associated with the high side 51 of the vessel 22. The reinforcing rod is bent about a plurality of reinforcing and positioning rods 53 and thence welded to the opposite side of the track at location 54. The track as positioned is thus accurately aligned in all directions with respect to the center line of vessel 22 and the liner 16. Hence, the track is accurately positioned.

Also shown in the FIG is the transverse reinforcing rod configuration 60 and 61 associated with the concrete bed 10. The reinforcing rods are positioned along the length of the track configuration at predetermined intervals and in essence, coact with reinforcing bars as 40 which are disposed relatively parallel to the concrete bed.

Figure 3:
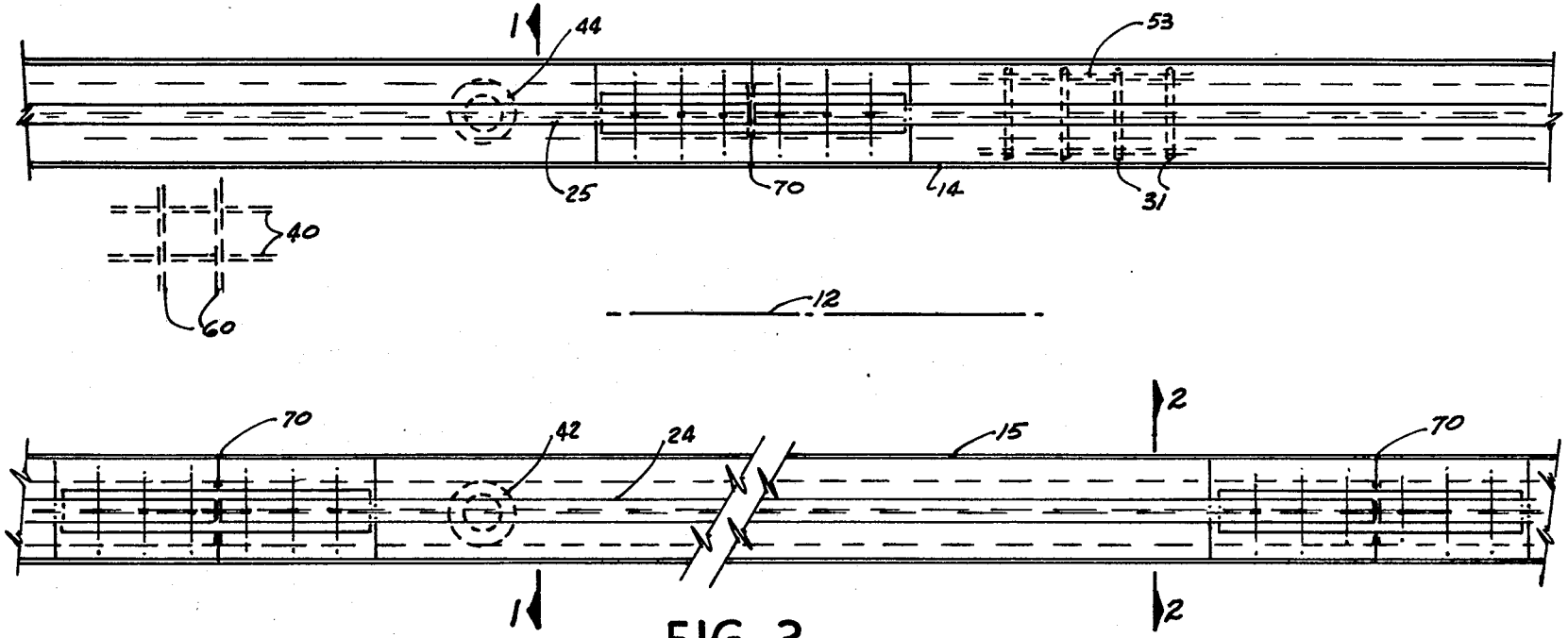
FIG. 3 is a top plan view depicting a track configuration.

Shown in FIG. 3 is a top plan view of a typical track layout as depicted in FIG. 1 showing the tracks 24 and 25 disposed within the recesses 14 and 15 in the concrete bed 10 and accurately aligned with respect to the apex 12 thus formed in the concrete bed. It is noted that FIG. 1 is a section taken through line 1—1 of FIG. 3, while FIG. 2 is a section taken through line 2—2 of FIG. 3.

It is also understood that the apparatus thus described can comprise straight as well as curved sections of track assembly formed according to the above described configurations.

It is also understood that the apparatus thus described facilitates the easy removal of a track section and the relacement of the same with an identical assembly. Essentially, a track as 24 is fully contained and aligned within an associated vessel 22.

Referring to FIG. 3, there is shown dividing lines as 70 to denote a particular length of track which may be a few to several feet in length. The section between line 70 is lifted from the channel 15 and replaced by another identical section. The replacement and removal of such sections may be accommodated manually or by typical hoist equipment conventionally found at an industrial location. In this manner, one can easily replace and remove the track sections as they wear or deteriorate in a rapid and effficient manner. It is further apparent that the entire assembly thus described completely eliminates the necessity for wooden railroad ties and hence, offers this further advantage above conventional track configurations now employed in industrial operations.

Essentially, as shown in FIG. 3, the track sections are joined together to form a unitary track configuration. The joint locations are staggered between the top and bottom tracks so as to distribute stress at the points during operation of a railroad car on the assembly.

Figure 4:
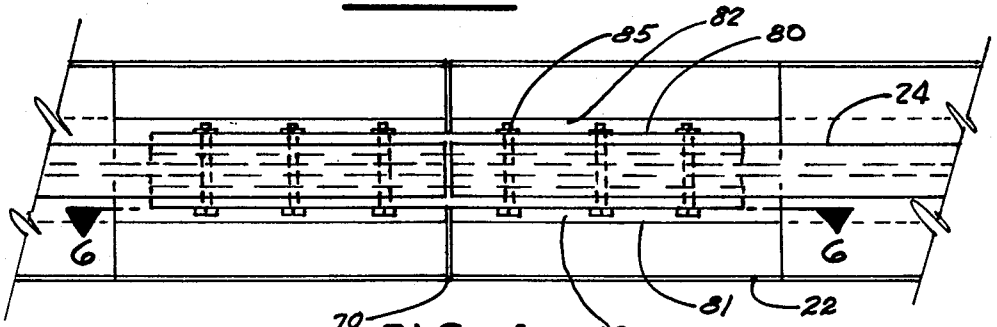
FIG. 4 is a top sectional view showing a means of joining one track assembly to the other.

Each track section, once emplaced in the respective channel, is joined at its end to another track section by means of conventional joint bars or splice bars 80 and 81 depicted in the top sectional view of FIG. 4. Essentially, the concrete binder in each vessel as 22 has formed at the end of each section, right and left apertures as 82 and 83. The track at the end has a plurality of holes drilled therein to accommodate a suitable nut and bolt assembly as 85 to thence join one like section of track to another by means of the joint bars 80 and 81. In this manner, there is no relative movement between one track section and another when joined accordingly.

Figure 5:
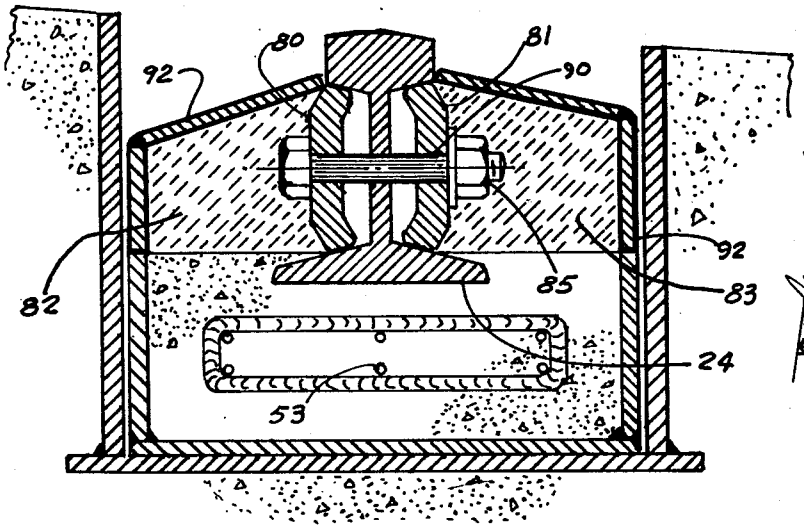
FIG. 5 is a cross-sectional view taken through an end of a track to be joined.

Referring to FIG. 5, there is shown a cross-sectional view of typical point bars 80 and 81 coupled to the track at the end of the same. As is seen, the concrete at the end portion is installed up to the bottom flange of the track 24, thus forming the associated apertures 82 and 83. Holes as 90 are predrilled into the end section of the track and the joint bars are coupled to the track by the insertion of a nut and bolt assembly 85 through the aperture 90.

A cover plate 92 fabricated from stainless steel is then inserted over the joint to cover the bars 80 and 81 and the bolt 85. The cover plate is of a triangular cross-sectional configuration as shown and is employed to cover the track joining apparatus.

Figure 6:
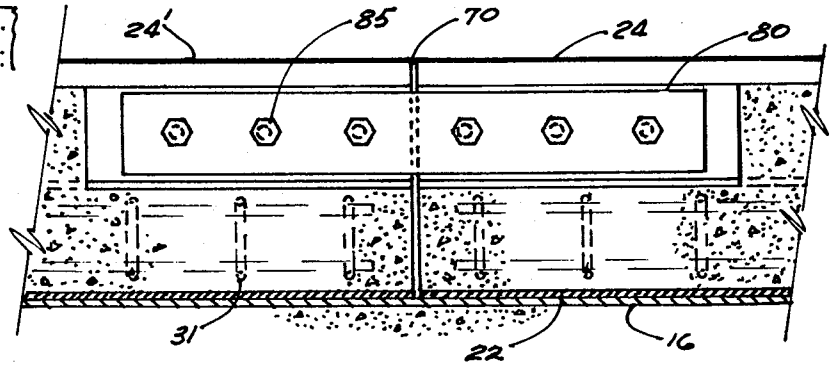
FIG. 6 is a side view showing a joint bar configuration operative to join one track assembly to another.

FIG. 6 shows a track section 24 joined to a track section 24' at a joint location 70. There is shown a side view of a joint bar such as 80 secured to both track sections at the flange of the track. The apertures as 82 formed in the concrete at the end of the track are clearly depicted. In this manner, the two track sections are joined together as indicated. When a section is to be removed, one then removes the cover plate 92, removes the bolts 85 and hence frees the track from the joint bars 80 and 81. The section can then be lifted and replaced as above described. The joining of the track as indicated further assures an integral strong structure preventing unnecessary movement of one track section with respect to another.

It is noted that due to the fact that the tracks are accurately aligned and positioned by means of the reinforcing bars and the concrete liner, the sections can be fabricated at suitable lengths and dimensions to insure that they are extremely heavy and hence, remain rigidly anchored within the accommodating channels formed in the concrete bed. There is, of course, enough tolerance provided to allow the normal vibrations and forces which exist during the operation of a railroad car over a track assembly without causing excessive movement of the structures depicted and without affecting the mechanical positioning of the apparatus.

There has thus been described a replaceable track assembly particularly adapted for use at industrial processing sites to enable the rapid positioning of track sections to thus substantially reduce replacement time and operation shut-down. The system operates in conjunction with drainage facilities which further serve to dispose of corrosive liquid substances which may fall from the railroad cars during operation to thus further prolong the effective life and utilization of the systems.

As can be seen from the FIGS, the entire concrete road bed has a top surface configuration of a triangular cross-section. The tracks as retained in the steel channels also have concrete surfaces which are tapered. The tapering of both the track structures and the bed facilitate the flow of fluid to enable the collection of such fluids by means of the recesses in the concrete.

May other advantages will become apparent to those skilled in the art and are deemed to be included within the scope and bounds of the apparatus described.

I claim:

1. A railroad track construction apparatus comprising a concrete bed of a predetermined length and having a top surface of a relatively triangular configuration forming a central apex relatively equidistant from a right and left side of said bed, said bed having first and second parallel "U" shaped channels located on said top surface, with said first channel nearer said right side and spaced a given distance from said apex, and said second channel nearer said left side and spaced relatively the same distance from said apex, a first and second channel vessel, each of a "U" cross-sectional configuration relatively congruent with said first and second channels for insertion of said first and second vessels in said first and second channels, said vessels including a first track positioned at a predetermined location in said first vessel, and a second track positioned at a predetermined location in said second vessel, each of said tracks extending from the open top of said "U" and positioned at said locations by means of a plurality of track supporting rods retained between said track and said vessels by means of a concrete binder located within the hollow of said "U" shaped vessel, wherein each of said supporting rods is of a relatively arcuate configuration having one end secured to a portion of said track at one side and a second end secured to a portion of said track at said opposite side with said rod disposed within said hollow of said "U" shaped vessel and having the major portion thereof facing the bottom surface of said vessel.

2. The apparatus according to claim 1 further comprising first and second "U" shaped liners disposed in said first and second channels in said bed and each fabricated from a corrosion resistant material.

3. The apparatus according to claim 2 wherein each of said "U" shaped liners has a bottom flanged surface to rigidly anchor the same within said concrete bed.

4. The apparatus according to claim 1 further comprising a series of drainage tubes each communicating with said first and second channels in said concrete bed to cause fluid within said channels to enter said drainage tubes.

5. The apparatus according to claim 1 wherein each of said "U" shaped vessels have one side arm of said "U" of a longer length than said other.

6. The apparatus according to claim 1 wherein said concrete binder slopes downwardly to the top of said "U" from said track location to said side arms.

7. The apparatus according to claim 1 wherein said concrete bed has embedded therein a plurality of reinforcing rods directed generally parallel to said first and second channels.

8. The apparatus according to claim 1 wherein said first and second vessels are fabricated from stainless steel.

9. Th apparatus according to claim 1 further comprising a plurality of reinforcing rods extending relatively parallel to said tracks and arranged about the inner periphery of said circular supporting rods.

10. The apparatus according to claim 1 wherein said first and second vessels are of a predetermined length, each having a first and a second end.

11. The apparatus according to claim 10 wherein each of said vessels includes means at said first and second ends for joining said vessel to a corresponding vessel to obtain an effective track length greater then said predetermined length.

12. The apparatus according to claim 11 wherein said means at said first and second ends includes first and second joint bars secured to said track associated with said vessel at said first and second ends, said first joint bar secured to said track at a right side of a central flange associated with said track and said second bar secured to said left side of said track, said bars contained within an aperture located on the surface of said concrete binder within said vessel and of a predetermined length at said ends.

13. The apparatus according to claim 12 further including a cover plate located at each of said ends to cover said joint bars and hence, said track coupling means.

* * * * *